US006218460B1

(12) United States Patent
Shin et al.

(10) Patent No.: US 6,218,460 B1
(45) Date of Patent: Apr. 17, 2001

(54) FIBERS FLASH-SPUN FROM FULLY HALOGENATED POLYMERS

(75) Inventors: Hyunkook Shin, Wilmington; William H. Tuminello, Newark, both of DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/346,411

(22) Filed: Jul. 1, 1999

Related U.S. Application Data

(63) Continuation-in-part of application No. PCT/US97/00155, filed on Jan. 9, 1997, now Pat. No. 9,830,739.

(51) Int. Cl.[7] ..... D01D 5/11; D01F 6/18; D01F 6/32; C08L 27/12; C08L 27/18

(52) U.S. Cl. ..... 524/546; 264/13; 264/14; 264/205; 524/462; 524/463; 524/544; 524/545

(58) Field of Search ..... 524/546, 545, 524/544, 462, 463; 264/13, 14, 205

(56) References Cited

U.S. PATENT DOCUMENTS

| | | | | |
|---|---|---|---|---|
| 3,227,664 | | 1/1966 | Blades et al. | 260/2.5 |
| 3,227,784 | | 1/1966 | Blades et al. | 264/53 |
| 3,227,794 | | 1/1966 | Anderson et al. | 264/205 |
| 3,282,875 | | 11/1966 | Connolly et al. | 260/29.6 |
| 3,484,899 | | 12/1969 | Smith | 18/8 |
| 3,584,090 | | 6/1971 | Parrish | 264/45 |
| 3,851,023 | | 11/1974 | Brethauer et al. | 264/24 |
| 4,358,545 | | 11/1982 | Ezzell et al. | 521/27 |
| 4,608,089 | | 8/1986 | Gale et al. | 106/90 |
| 4,940,525 | | 7/1990 | Ezzell et al. | 204/252 |
| 5,147,586 | | 9/1992 | Shin et al. | 264/13 |
| 5,279,776 | | 1/1994 | Shah | 264/12 |
| 5,290,846 | | 3/1994 | Tuminello | 524/463 |
| 5,328,946 | | 7/1994 | Tuminello et al. | 524/462 |
| 5,364,929 | | 11/1994 | Dee et al. | 528/491 |
| 5,985,196 | * | 11/1999 | Shin | 264/205 |
| 6,034,008 | * | 3/2000 | Lim | 442/334 |
| 6,136,911 | * | 10/2000 | Shin | 524/463 |

* cited by examiner

*Primary Examiner*—Fred Zitomer

(57) ABSTRACT

A flash-spun material comprised of at least 90% by weight of polymers selected from the groups A, B, and C; wherein group A comprises polymers with a melting point above 280° C. that are comprised of halocarbon polymers in which at least 20% of the total number of halogen atoms in each halocarbon polymer are fluorine atoms; wherein group B comprises polymers with a melting point above 280° C. that are comprised of oxyhalocarbon polymers in which at least 20% of the total number of halogen atoms in each oxyhalocarbon polymer are fluorine atoms; and wherein group C comprises fully halogenated, highly fluorinated ion exchange polymers. A process for producing such flash-spun material and a solvent for producing such flash-spun material are also provided.

17 Claims, 3 Drawing Sheets

FIBERS FLASH-SPUN FROM FULLY HALOGENATED POLYMERS

This is a continuation-in-part of International Application No. PCT/US97/00155, filed Jan. 9, 1997, which was published as International Publication No. WO 98/30739 on Jul. 16, 1998.

BACKGROUND OF THE INVENTION

This invention relates to fibers that are flash-spun from fully halogenated hydrocarbon polymers and a solvent, and more particularly to flash-spun fully halogenated hydrocarbon polymers in which a substantial number of the polymer's halogen atoms are fluorine atoms.

The art of flash-spinning strands of plexifilamentary film-fibrils from polymer in a solution or a dispersion is known in the art. The term "plexifilamentary" means a three-dimensional integral network of a multitude of thin, ribbon-like, film-fibril elements of random length and with a mean film thickness of less than about 4 microns and a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

U.S. Pat. No. 3,227,784 to Blades et al. (assigned to E. I. du Pont de Nemours & Company ("DuPont")) describes a process wherein a polymer in solution is forwarded continuously to a spin orifice at a temperature above the boiling point of the solvent, and at autogenous pressure or greater, and is flash-spun into a zone of lower temperature and substantially lower pressure to generate a strand of plexifilamentary material. U.S. Pat. No. 3,227,794 to Anderson et al. (assigned to DuPont) teaches that plexifilamentary film-fibrils are best obtained from solution when fiber-forming polymer is dissolved in a solvent at a temperature and at a pressure above which two liquid phases form, which pressure is generally known as the cloud point pressure at the given temperature. This solution is passed to a pressure let-down chamber, where the pressure decreases below the cloud point pressure for the solution thereby causing phase separation. The resulting two phase dispersion of a solvent-rich phase in a polymer-rich phase is discharged through a spinneret orifice to form the plexifilamentary strand.

U.S. Pat. No. 3,484,899 to Smith (assigned to DuPont) discloses an apparatus with a horizontally oriented spin orifice through which a plexifilamentary strand can be flash-spun. The polymer strand is conventionally directed against a rotating lobed deflector baffle to spread the strand into a more planar web structure that the baffle alternately directs to the left and right as the web descends to a moving collection belt. The fibrous sheet formed on the belt has plexifilamentary film-fibril networks oriented in an overlapping multi-directional configuration.

Many improvements to the basic flash-spinning process have been reported or patented over the years. Flash-spinning of olefin polymers to produce non-woven sheets is practiced commercially and is the subject of numerous patents including U.S. Pat. No. 3,851,023 to Brethauer et al (assigned to DuPont). Flash-spinning of olefin polymers to produce pulp-like products from polymer solutions is disclosed in U.S. Pat. No. 5,279,776 to Shah (assigned to DuPont). Flash-spinning of olefin polymers to produce microcellular and ultra-microcellular foam products from polymer solutions is disclosed in U.S. Pat. No. 3,227,664 to Blades et al. and 3,584,090 to Parrish (assigned to DuPont).

The commercial application for flash-spinning has been primarily directed to the manufacture of polyolefin plexifilaments, especially of polyethylene and polypropylene. However, experimental work directed to the flash-spinning of other polymers, has been reported. For example, U.S. Pat. No. 3,227,784 to Blades et al. describes the flash-spinning of a solution of a perfluoroethylene/perfluoropropylene (90:10) copolymer from a solution in p-bis(trifluoromethyl)benzene (Example 30). Applicants are not aware of commercial flash-spinning of such fluoropolymers. U.S. Pat. Nos. 5,328,946 and 5,364,929 disclose solutions of tetrafluoroethylene polymers at superautogenous pressure in perfluorinated cycloalkane solvents.

As used in this application, "hydrocarbon" refers to organic compounds consisting primarily of carbon and hydrogen; "halocarbon" refers to organic compounds comprised exclusively of carbon and halogens; and "oxyhalocarbon" refers to organic compounds comprised exclusively of carbon, oxygen and halogens.

Highly fluorinated polymer and copolymer films exhibit a variety of outstanding characteristics such as excellent resistance to acids, bases, and most organic liquids under normal temperature and pressure conditions; excellent dielectric properties; good tensile properties; good resistance to heat and weather; a very high melting point; and nonflammability. Highly fluorinated polymers and copolymer films are extensively used in high value applications such as insulation for high speed electrical transmission cables. Flash-spun plexifilaments of highly fluorinated halocarbon polymers and copolymers should find wide use in other high value applications such as, for example, hot gas filtration media, pump packings, gaskets, and protective apparel. However, fully halogenated polymers such as Teflon PTFE and Teflon PFA have very high melting temperatures (327° C. and 305° C., respectively). In addition, they are among the most inert known compounds. Consequently, fully halogenated polymers such as Teflon PTFE and Teflon PFA are very difficult to dissolve, even at high temperatures and pressures. Due to the extreme chemical inertness and intractability of fully halogenated polymers, it had not been possible to flash-spin such polymers.

There is a need for plexifilaments, microcellular foam fibers and microcellular foam sheets comprised of highly fluorinated polymers and copolymers that exhibit excellent heat and chemical resistance, good dielectric properties, and good non-stick characteristics. There also is a need for a process suitable for use in commercial flash-spinning of highly fluorinated hydrocarbon polymers using conventional spinning equipment under commercial temperature and pressure conditions.

SUMMARY OF THE INVENTION

According to the present invention, there is provided a flash-spun material comprised of at least 90% by weight of polymers selected from the groups A, B, and C; wherein group A comprises polymers with a melting point above 280° C. that are comprised of halocarbon polymers in which at least 20% of the total number of halogen atoms in each halocarbon polymer are fluorine atoms; wherein group B comprises polymers with a melting point above 280° C. that are comprised of oxyhalocarbon polymers in which at least 20% of the total number of halogen atoms in each oxyhalocarbon polymer are fluorine atoms; and wherein group C comprises fully halogenated, highly fluorinated ion exchange polymers. Preferably, fluorine comprises at least 95% of the halogen atoms in at least 80% by weight of the polymers from groups A, B and C. According to one preferred embodiment of the invention, at least 80% by weight of the group A halocarbon polymers and said group B oxyhalocarbons are comprised of tetrafluoroethylene. According to another preferred embodiment of the invention, the group C fully halogenated, highly fluorinated ion exchange polymers comprise at least 80% by weight copolymers of tetrafluoroethylene and perfluoro(substituted alkyl vinyl ether).

The flash-spun material may be a plexifilamentary strand having a surface area, measured by the BET nitrogen adsorption method, greater than 2 $m^2/g$ comprising a three dimensional integral plexus of semicrystalline, polymeric, fibrous elements, said elements being co-extensively aligned with the network axis and having the structural configuration of oriented film-fibrils, said film-fibrils having a mean film thickness of less than 4 microns and a median fibril width of less than 25 microns. Alternatively, the flash-spun material may be a microcellular foam comprising closed polyhedral cells of polymeric material having thin film-like cell walls with an average thickness of less than 4 microns between adjoining cells.

According to the invention, there is also provided a process for the production of flash-spun material comprised of a polymer that belongs to groups A, B and C, as defined above. The process comprises the steps of: forming a spin solution of the polymer in a solvent, the solvent having an atmospheric boiling point between 0° C. and 200° C., and being selected from the group consisting of perfluorinated hydrocarbons including cyclic and multi-ring compounds, perfluorinated morpholines, hydrofluorocarbons, and hydrofluoroethers; and spinning the spin solution at a pressure that is greater than the autogenous pressure of the spin solution into a region of substantially lower pressure and at a temperature at least 50° C. higher than the atmospheric boiling point of the solvent. The spin solution has a cloud point pressure of between the autogenous pressure and 50 MPa at temperatures in the range of 150° C. to 280° C. The spin solution may be spun at a pressure of between the autogenous pressure and the cloud point pressure to form plexifilamentary film-fibril strands, or it may be spun at a pressure of between the cloud point pressure and 50 MPa to form a microcellular foam.

According to the invention, there is also provided a solution comprising a solvent having an atmospheric boiling point of less than 200° C., and a fully halogenated, highly fluorinated ion exchange polymer, wherein the solution is at a pressure between the autogenous pressure and 50 MPa and at a temperature of between 150° to 280° C., the concentration of dissolved polymer in the solution being within the range of 5 to 60 weight percent of the solution.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION

Figure 1:
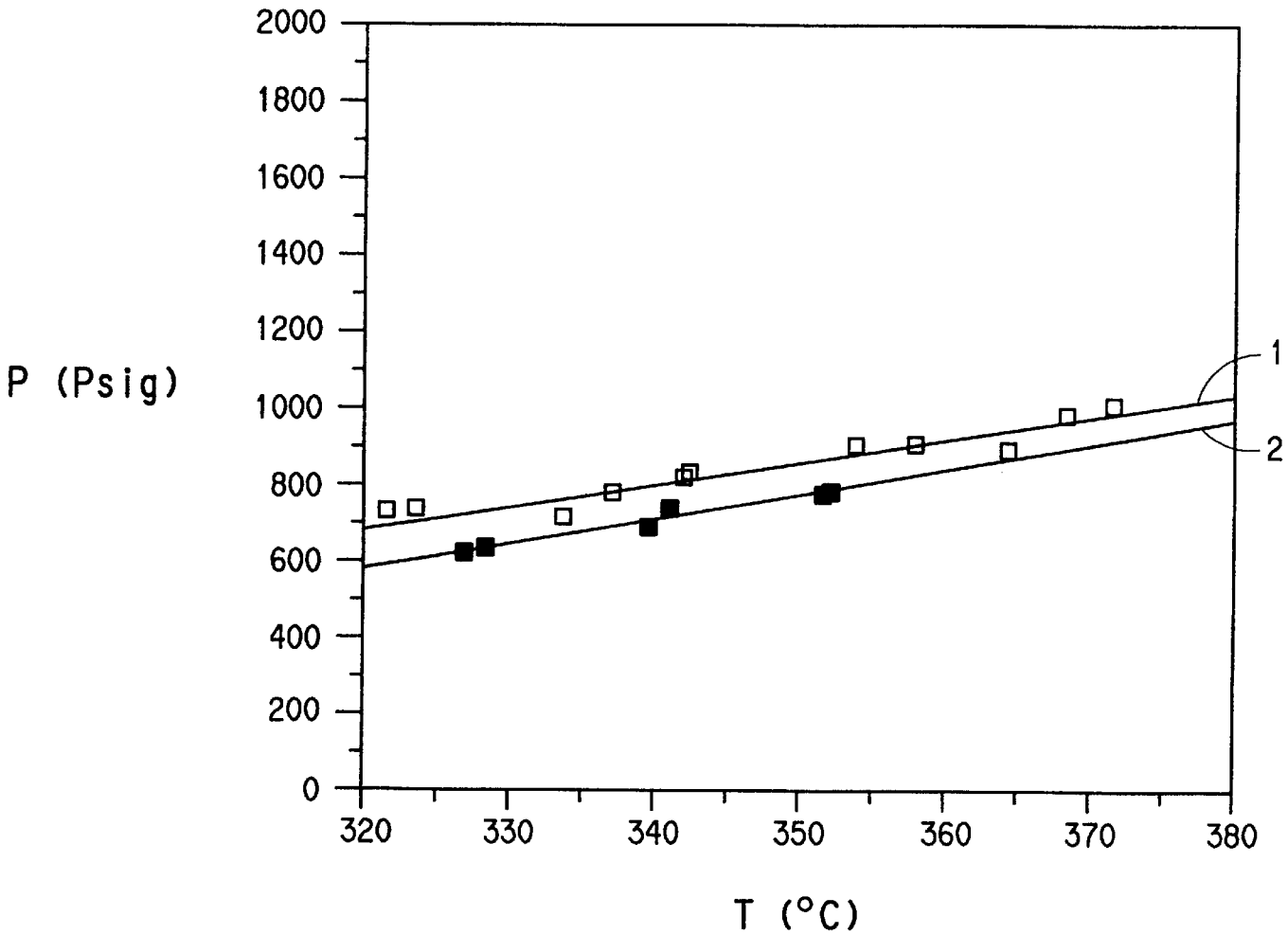
FIG. 1 is a plot of the cloud point data for a solution comprised of polytetrafluoroethylene at two concentrations in a solvent of perfluorodecalin.

Reference will now be made in detail to the presently preferred embodiments of the invention, examples of which are illustrated below.

The flash-spun halogenated plexifilaments of the invention can be spun using the apparatus and flash-spinning process disclosed and fully described in U.S. Pat. No. 5,147,586 to Shin et al., which is hereby incorporated by reference. It is anticipated that in commercial applications, fully halogenated plexifilamentary sheets could be produced using the apparatus disclosed in U.S. Pat. No. 3,851,023 to Brethauer et al.

The process for flash-spinning plexifilaments from a fully halogenated hydrocarbon polymer and a solvent, especially when the polymer is a fully fluorinated polymer, operates under conditions of elevated temperature and pressure. The polymeric starting material is normally not soluble in the selected solvent under normal temperature and pressure conditions but forms a solution at certain elevated temperatures and pressures. In the flash-spinning process for making plexifilaments, pressure is decreased below the cloud point to cause phase separates, just before the solution is passed through a spinneret. When the solution pressure is lowered below the cloud point pressure, the solution phase separates into a polymer-rich phase and a solvent-rich phase. Upon passing through the spinneret at very high speed into a zone of substantially lower pressure, the solvent flashes off quickly and the polymer material present in the polymer-rich phase freezes in an elongated plexifilamentary form.

The morphology of fiber strands obtained by solution flash-spinning of fully halogenated polymer is greatly influenced by the type of solvent in which the polymer is dissolved, the concentration of the polymer in the spin solution, and the spin conditions. To obtain plexifilaments, the polymer concentration is kept relatively low (e.g., less than about 20 weight percent), while spin temperatures and pressures are generally kept high enough to provide rapid flashing of the solvent. Microcellular foam fibers of fully halogenated polymers, on the other hand, are usually prepared at polymer concentrations greater than 20% and at lower spin temperatures and pressures.

Well fibrillated plexifilaments are usually obtained when the spin temperature used is between the critical temperature of the spin liquid and 40° C. below the critical temperature, and when the spin pressure is slightly below the cloud point pressure. When the spin pressure is much greater than the cloud point pressure of the spin mixture, coarse plexifilamentary "yarn-like" strands are usually obtained. As the spin pressure is gradually decreased, the average distance between the tie points of the fibrils of the strands generally becomes shorter while the fibrils become progressively finer. When the spin pressure approaches the cloud point pressure of the spin mixture, very fine fibrils are normally obtained, and the distance between the tie points becomes very short. As the spin pressure is further reduced to below the cloud point pressure, the distance between the tie points becomes longer. Well fibrillated plexifilaments, which are most suitable for sheet formation, are usually obtained when spin pressures slightly below the cloud point pressure are used. The use of pressures which are too much lower than the cloud point pressure of the spin mixture generally leads to a relatively coarse fiber structure. In some cases, well fibrillated plexifilaments can be obtained even at spin pressures slightly higher than the cloud point pressure of the spin mixture.

For flash-spinning of microcellular foam fibers, relatively strong solvents are used to obtain relatively low cloud point pressures. Microcellular foams are usually prepared at relatively high concentrations of the fully halogenated polymer in the spinning solution and at relatively low spinning temperatures and pressures that are above the cloud point pressure. Microcellular foam fibers may be obtained rather than plexifilaments, even at spinning pressures slightly below the cloud point pressure of the solution. Nucleating agents, such as fused silica and kaolin, may be added to the spin mix to facilitate solvent flashing and to obtain uniform small size cells. Microcellular foams can be obtained in a collapsed form or in a fully or partially inflated form. For many polymer/solvent systems, microcellular foams tend to collapse after exiting the spinning orifice as the solvent vapor condenses inside the cells and/or diffuses out of the cells. To obtain low density inflated foams, inflating agents are usually added to the spin liquid. Inflating agents should have a permeability coefficient for diffusion through the cell walls that is less than that of air so that the agent can stay inside the cells for a long period of time while allowing air to diffuse into the cells to keep the cells inflated. Osmotic pressure will cause air to diffuse into the cells. Suitable inflating agents that can be used include low boiling temperature partially halogenated hydrocarbons and halocarbons such as hydrochlorofluorocarbons, hydrofluorocarbons, chlorofluorocarbons, and perfluorocarbons; inert gases such as carbon dioxide and nitrogen; low boiling temperature hydrocarbon solvents such as butane and isopentane; and other low boiling organic solvents and gases. The atmospheric boiling points will be around room temperature or lower.

Microcellular foam fibers are normally spun from a round cross section spin orifice. However, an annular die similar to the ones used for blown films can be used to make flash-spun microcellular foam sheets. Fully inflated foams, as-spun fibers or as-extruded foam sheets can be post-inflated by immersing them in a solvent containing dissolved inflatants. Inflatants will diffuse into the cells due to the plasticizing action of the solvent. Once dried, the inflatants will stay inside the cells and air will diffuse into the cells due to osmotic pressure to keep the microcellular foams inflated. Microcellular foams have densities between 0.005 and 0.50 g/cc. Their cells are generally of a polyhedral shape and their average cell size is less than about 300 microns, and is preferably less than about 150 microns. Their cell walls are generally less than about 3 microns thick, and they are typically less than about 2 microns in thickness.

Plexifilamentary pulps of fully halogenated polymers can be produced by disc refining flash-spun plexifilaments as disclosed in U.S. Pat. No. 4,608,089 to Gale et al. (assigned to DuPont). Alternatively, such pulps can be prepared directly from polymer solutions by flash-spinning using a device similar to the one disclosed in U.S. Pat. No. 5,279,776 (assigned to DuPont). These pulps are plexifilamentary in nature and they can have a three dimensional network structure. However, the pulp fibers are relatively short in length and they have small dimensions in the transverse direction. The average fiber length is less than about 200 microns, and is preferably less than 50 microns. The pulp fibers have a relatively high surface area of greater than 2 $m^2/g$.

Polymers that may be flash-spun to produce the highly fluorinated polymer plexifilaments of the invention are fully halogenated hydrocarbon polymers in which at least 20% of the halogen atoms are fluorine atoms. Preferably, the fully halogenated hydrocarbon polymers are polymers in which at least 95% of the halogen atoms in at least 80% of the halogenated polymers are fluorine atoms.

Fully halogenated polymers with melting points above 280° C. that may be flash-spun to produce the flash-spun polymer material of the invention include polytetrafluoroethylene [$—(CF_2CF_2)—$], tetrafluoroethylene/hexafluoropropylene copolymer [$—(CF_2CF_2)_a—(CF(CF_3)CF_2)_b—$], and tetrafluoroethylene/perfluoro(propyl vinyl ether) copolymer [$—(CF_2CF_2)_a—(CF(OC_3F_7)CF_2)_b—$]. Another perfluorinated copolymer with a somewhat lower melting point that may be flash-spun is a copolymer of tetrafluoroethylene and a perfluoro(substituted alkyl vinyl ether), as for example [$—(CF_2CF_2)_a—(CF(OCF_2CF(CF_3)OCF_2CF_2SO_2F)CF_2)_b—$], which is a perfluorinated ion exchange polymer resin (sold in its hydrolyzed form by DuPont under the name Nafion®). Examples of perfluorinated ion exchange polymers are disclosed in U.S. Pat. No. 3,282,875 (assigned to DuPont).

As used herein, "fully halogenated, highly fluorinated ion exchange polymers" include both the hydrolyzed and unhydrolyzed forms. Preferably, the unhydrolyzed form is flash-spun and then subsequently hydrolyzed by treatment with a base such as sodium hydroxide. "Highly fluorinated" means that at least 90% of the total number of halogen atoms in the polymer are fluorine atoms. Most preferably, the ion exchange polymer is perfluorinated.

Preferably, the polymers of the fully halogenated, highly fluorinated ion exchange polymers comprise a polymer backbone with recurring side chains attached to the backbone with the side chains carrying cation exchange groups. Possible polymers include homopolymers or copolymers of two or more monomers. Copolymers are typically formed from a first monomer which is a nonfunctional monomer and provides carbon atoms for the polymer backbone, and a second monomer which provides both carbon atoms for the polymer backbone and also contributes the side chain carrying the cation exchange group or its precursor, e.g., a sulfonyl halide group such a sulfonyl fluoride ($—SO_2F$), which can be subsequently hydrolyzed to a sulfonate functional group. For example, the ion exchange polymer may be a copolymer of a first fluorinated vinyl monomer together with a second fluorinated vinyl monomer having a sulfonyl fluoride group ($—SO_2F$). Other possible first monomers include tetrafluoroethylene (TFE), hexafluoropropylene, vinyl fluoride, vinylidine fluoride, trifluorethylene, chlorotrifluoroethylene, perfluoro (alkyl vinyl ether), and mixtures thereof. Other possible second monomers include a variety of fluorinated vinyl ethers or perfluoro(substituted alkyl vinyl ethers) with sulfonate functional groups or precursor groups which can provide the desired side chain in the polymer. The first monomer may also have a side chain which does not interfere with the ion exchange function of the sulfonate functional group. Additional monomers can also be incorporated into these polymers if desired.

A class of preferred ion exchange polymers for use in the present invention include a highly fluorinated, most preferably perfluorinated, carbon backbone with a side chain is represented by the formula $—(O—CF_2CFR_f)_a—O—CF_2CFR'_fSO_3X$, wherein $R_f$ and $R'_f$ are independently selected from F, Cl or a perfluorinated alkyl group having 1 to 10 carbon atoms, a=0, 1 or 2, and X is H, Li, Na, K or $N(R^1)(R^2)(R^3)(R^4)$ and $R^1$, $R^2$, $R^3$, and $R^4$ are the same or different and are H, $CH_3$ or $C_2H_5$. The preferred ion exchange polymers include, for example, polymers disclosed in U.S. Pat. No. 3,282,875 and in U.S. Pat. Nos. 4,358,545 and 4,940,525. One preferred ion exchange polymer comprises a perfluorocarbon backbone with a side chain represented by the formula —O—$CF_2CF(CF_3)$—O—$CF_2CF_2SO_3X$, wherein X is as defined above. Polymers of this type are disclosed in U.S. Pat. No. 3,282,875 and can be made by copolymerization of tetrafluoroethylene (TFE) and the perfluorinated vinyl ether $CF_2$=CF—O—$CF_2CF(CF_3)$—O—$CF_2CF_2SO_2F$, perfluoro(3,6-dioxa-4-methyl-7-octenesulfonyl fluoride) (PDMOF), followed by conversion to sulfonate groups by hydrolysis of the sulfonyl halide groups and ion exchanging if needed to convert to the desired form. In this application, "Nafion® XR" refers to the unhydrolyzed form of a perfluorinated ion exchange copolymer of TFE and PDMOF with an equivalent weight of 1100. For perfluorinated polymers of this type, the relative ratios of the monomers can be described in terms of the equivalent weight (EW). Equivalent weight is defined to be the weight of the polymer in acid form required to neutralize one equivalent of NaOH. One preferred polymer of the type disclosed in U.S. Pat. Nos. 4,358,545 and 4,940,525 has the side chain —O—$CF_2CF_2SO_3X$, wherein X is as defined above. This polymer can be made by copolymerization of tetrafluoroethylene (TFE) and the perfluorinated vinyl ether $CF_2$=CF—O—$CF_2CF_2SO_2F$, perfluoro(3-oxa-4-pentenesulfonyl fluoride) (POPF), followed by hydrolysis and acid exchange if needed. Other classes of ion exchange polymers that could be used in the present invention include those described above wherein the sulfonate functional group is replaced with carboxylate, phosphonate, imide, sulfonimide or sulfonamide functional groups.

While the temperature and pressure conditions that can be withstood by solution flash-spinning equipment are quite broad, it is generally preferred not to operate under extreme temperature and pressure conditions. The preferred temperature range for flash-spinning the fully halogenated polymers flash-spun according to the invention is about 200° to 400° C. while the preferred pressure range is from the autogenous pressure for the solution to about 7250 psig (50 MPa), and more preferably from the autogenous pressure of the solution to 3625 psig (25 MPa). As used herein, "autogenous pressure" is the natural vapor pressure of the spin material at a given temperature. Therefore, if plexifilaments are to be flash-spun from fully halogenated polymers in solution, the solvent should dissolve the fully halogenated polymers at pressures and temperatures within the preferred ranges. In order to generate the two phase solution that is needed for flash-spinning plexifilamentary film-fibrils, the solution must also have a cloud point pressure that is within the desired pressure and temperature operating ranges. In addition, the solution must form the desired two phases at a pressure that is sufficiently high to generate the explosive flashing required for the formation of plexifilaments.

Among all of the man-made polymers, Teflon PTFE is probably the most difficult polymer to dissolve, and therefore is just about the most difficult polymer to flash-spin. We have found that Teflon PTFE does not become soluble until it is heated to 300° C. or higher under pressure. Even at that high temperature and pressure, the only solvents that can dissolve Teflon PTFE have been found to be perfluorinated multi-ring compounds such as perfluorodecalin ($C_{10}F_{18}$, b.p.=142° C.) and perfluoroperhydrophenanthrene ($C_{14}F_{24}$, b.p.=142° C.). Perfluorinated multi-ring compounds are sold by BNFL Fluorochemicals, Ltd., of the United Kingdom, under the trade names: Flutec PP6 ($C_{10}F_{18}$, b.p.=142° C.); Flutec PP9 ($C_{11}F_{20}$, b.p.=160° C.); Flutec PP10 ($C_{13}F_{22}$, b.p.=190° C.); Flutec PP11 ($C_{14}F_{24}$, b.p.=215° C.); and Flutec PP24 ($C_{16}F_{26}$, b.p.=244° C.). Among these solvent compounds, perfluorodecalin has been found to be the most suitable flash-spinning agent for Teflon PTFE, as it appears to be the lowest boiling solvent that can dissolve Teflon PTFE for flash-spinning.

Teflon PFA is slightly more soluble than Teflon PTFE. We have found that Teflon PFA is soluble at high temperatures and pressures in some of the perfluorinated solvents such as perfluoro-N-methylmorpholine (3M's PF5052), perfluorohexane and perfluorocyclohexane; and in some of the hydrofluorocarbons such as HFC-4310mee (DuPont's Vertrel XF), in addition to the above mentioned perfluorinated multi-ring compounds. However, perfluorodecalin has been found to be the most suitable flash-spinning agent for Teflon PFA.

Perfluorinated ion exchange resins can be dissolved at high temperatures and pressures in some of the perfluorinated solvents such as perfluoro-N-methylmorpholine (3M's PF5052), perfluorohexane and perfluorocyclohexane; in some of the hydrofluorocarbons such as HFC-4310mee (DuPont's Vertrel XF); and in some of the hydrofluoroethers such as 1,1,1,2,2,3,3-fluoropropyl-1,2,2,2-fluoroethyl ether (i.e., $CF_3CF_2CF_2$—O—$CHFCF_3$). These ion exchange resins are also soluble at elevated temperatures and pressures in the perfluorinated multi-ring compounds mentioned above. We have used perfluoro-N-methylmorpholine and perfluorodecalin successfully to flash-spin Nafion® ion exchange resins to obtain plexifilamentary yarns. For flash-spinning microcellular foam fibers and sheets, perfluorodecalin can be used.

The apparatus and procedure for determining the cloud point pressures of a polymer/solvent combination are those described in the above-cited U.S. Pat. No. 5,147,586 to Shin et al. The cloud point pressures at different temperatures of a number of fully fluorinated polymers in selected solvents or pairs of solvents are given in FIGS. 1–3. These plots are used in determining whether flash-spinning of a particular polymer/solvent combination is feasible. Above each curve, the polymer is completely dissolved in the solvent system. Below each curve, separation into a polymer-rich phase and a solvent-rich phase takes place. At the boundary line, the separation into phases disappears when passing from lower pressures to higher pressures, or phase separation begins when passing from higher pressures to lower pressures.

FIG. 1 is a plot of the cloud point pressures at different temperatures for a solution of polytetrafluoroethylene [—($CF_2CF_2$)—] in perfluorodecalin. FIG. 1 provides this cloud point data at two different concentrations of the fluoropolymers, 2% (curve 1) and 15% (curve 2) by weight.

Figure 2:
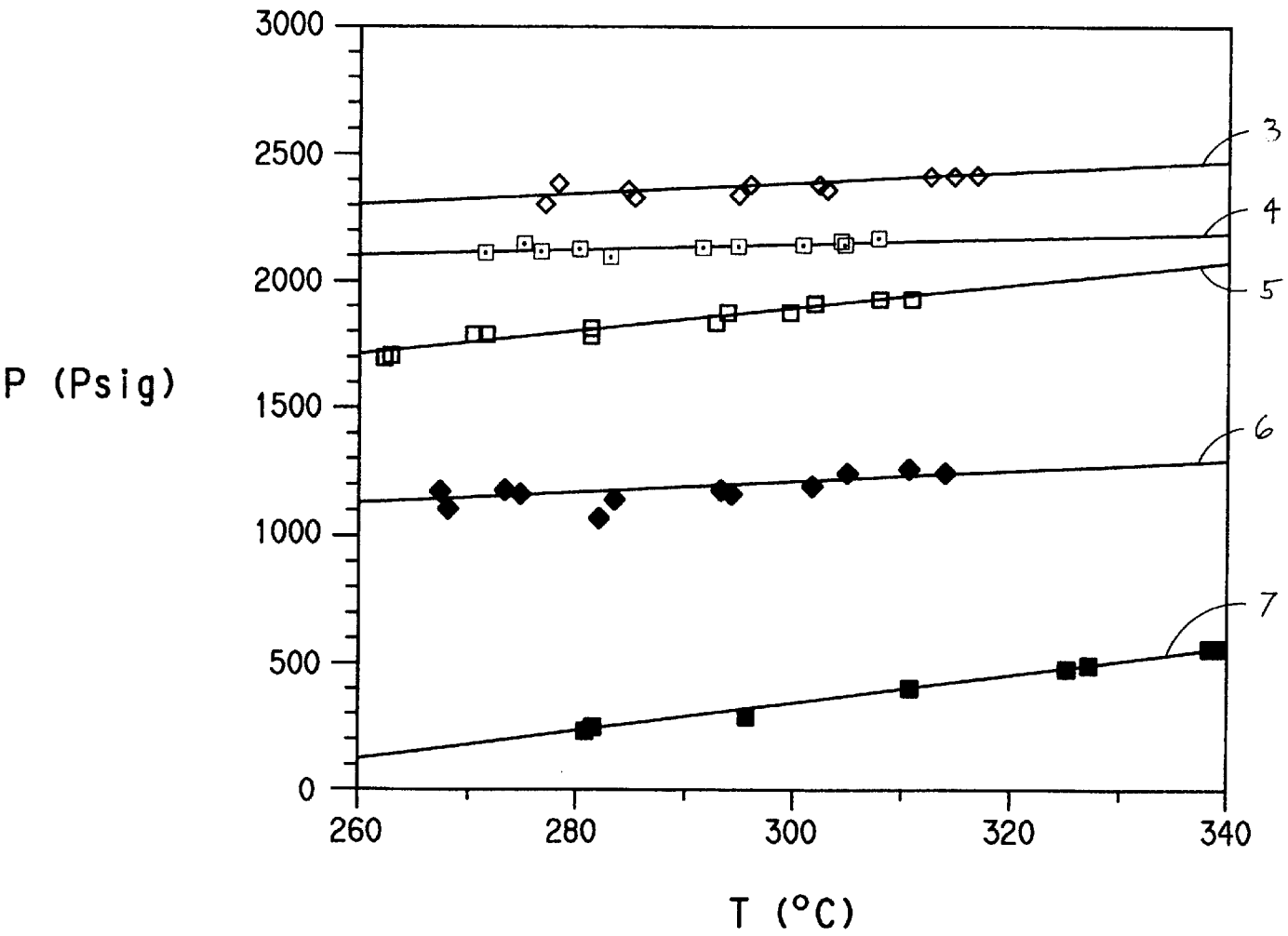
FIG. 2 is a plot of the cloud point data for a solution comprised of 30% of a copolymer of tetrafluoroethylene and perfluoro(propyl vinyl ether) in a variety of different solvents.

FIG. 2 is a plot of the cloud point data for a solution of 30% by weight of tetrafluoroethylene/perfluoro(propyl vinyl ether) copolymer [—$(CF_2CF_2)_a$—$(CF(OC_3F_7)CF_2)_b$—] in the following solvents: HFC-4310mee (DuPont's Vertrel XF) (curve 3); Vertrel 245 (perfluoro(dimethylcyclobutane)) obtained from DuPont (curve 4); PF5052 (perfluoro-N-methylmorpoholine) obtained from 3M (curve 5); a perfluorinated solvent with a boiling poing of 97° C. and an average molecular weight of 415 sold by 3M under the tradename of FC-77 (curve 6); and PP6 (perfluorodecalin) (curve 7).

Figure 3:
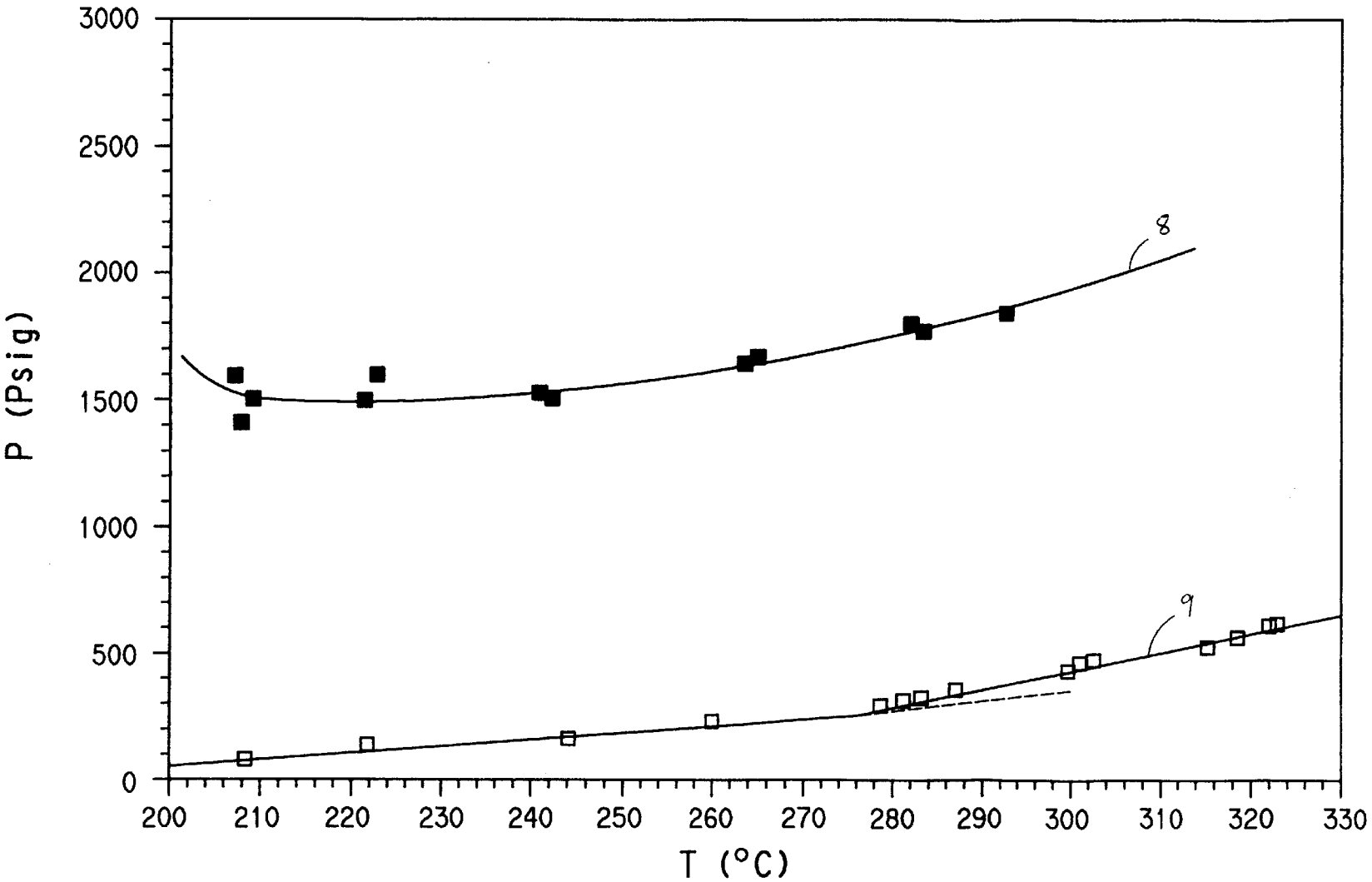
FIG. 3 is a plot of the cloud point data for a solution comprised of 12% of a perfluorinated ion exchange polymer resin (Nafion® XR obtained from DuPont) in a solvent of either perfluorodecalin or perfluoro-N-methylmorpholine.

FIG. 3 is a plot of the cloud point data for a solution of 12% of Nafion® XR perfluorinated ion exchange resin by weight copolymer of tetrafluoroethylene and perfluoro (substituted alkyl vinyl ether) [—$(CF_2CF_2)_a$—$(CF(OCF_2CF(CF_3)OCF_2CF_2SO_2F)CF_2)_b$—] in perfluoro-N-methylmorpholine (curve 8) and in perfluorodecalin (curve 9).

This invention will be now illustrated by the following non-limiting examples which are intended to illustrate the invention and not to limit the invention in any manner.

EXAMPLES

TEST METHODS

In the description above and in the non-limiting examples that follow, the following test methods were employed to determine various reported characteristics and properties.

The denier of the strand is determined from the weight of a 15 cm sample length of strand.

Tenacity, elongation and toughness of the flash-spun strand are determined with an Instron tensile-testing machine. The strands are conditioned and tested at 70° F. and 65% relative humidity. The strands are then twisted to 10 turns per inch and mounted in the jaws of the Instron Tester. A two-inch gauge length was used with an initial elongation rate of 4 inches per minute. The tenacity at break is recorded in grams per denier (gpd). The elongation at break is recorded as a percentage of the two-inch gauge length of the sample. Toughness is a measure of the work required to break the sample divided by the denier of the sample and is recorded in gpd. Modulus corresponds to the slope of the stress/strain curve and is expressed in units of gpd.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem. Soc., V. 60 p 309–319 (1938) and is reported as $m^2/g$.

Test Apparatus for Examples 1–27

The apparatus used in the examples 1–27 is the spinning apparatus described in U.S. Pat. No. 5,147,586. The apparatus consists of two high pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with both a length and a diameter shown in the table below (0.076 cm). Orifice measurements are expressed in mils [1 mil=0.0254 mm]. In some cases, a tunnel was located at the exit of the spin orifice. the tunnel has a diameter several times that of the spin orifice. Tunnels are used in flash-spinning to obtain a more columnar jet. The tunnel in Examples 1, 8 and 12 was a conical tunnel that diverged from the orifice opening at an angle of 60° for approximately 100 mil (25 mm). All other tunnels were cylindrical and have the dimensions list in the tables below. The pistons are driven by high pressure water supplied by a hydraulic system.

In the tests reported in Examples 1–27, the apparatus described above was charged with pellets of a partially fluorinated polymer and a solvent. High pressure water was used to drive the pistons to generate a mixing pressure of between 1500 and 3000 psi (10,340–10,680 kPa). The polymer and solvent were next heated to mixing temperature and held at that temperature for about an hour during which time the pistons were used to alternately establish a differential pressure of about 50 psi (345 kPa) or higher between the two cylinders so as to repeatedly force the polymer and solvent through the mixing channel from one cylinder to the other to provide mixing and effect formation of a spin mixture. The spin mixture temperature was then raised to the final spin temperature, and held there for about 15 minutes to equilibrate the temperature, during which time mixing was continued. In order to simulate a pressure letdown chamber, the pressure of the spin mixture was reduced to a desired spinning pressure just prior to spinning. This was accomplished by opening a valve between the spin cell and a much larger tank of high pressure water ("the accumulator") held at the desired spinning pressure. The spinneret orifice is opened about one to five seconds after the opening of the valve between the spin cell and the accumulator. This period roughly corresponds to the residence time in the letdown chamber of a commercial spinning apparatus. The resultant flash-spun product is collected in a stainless steel open mesh screen basket. The pressure recorded just before the spinneret using a computer during spinning is entered as the spin pressure.

The experimental conditions and the results for Examples 1–27 are given below in the Tables 1–6. All the test data not originally obtained in the SI system of units has been converted to the SI units.

Examples 1–3

In Examples 1–3, different concentrations of a copolymer comprised of polymerized monomer units of tetrafluoroethylene and perfluoro(propyl vinyl ether) (Teflon® PFA obtained from DuPont) were flash-spun from perfluorodecalin to form plexifilaments. The Teflon® PFA (grade 350) was a high molecular weight grade with a melting point of 305° C.

TABLE 1

| | POLYMER | | | MIXING | | | SPINNING Orifice | | | Properties @ 10 TPI | | | | | |
|---|---|---|---|---|---|---|---|---|---|---|---|---|---|---|---|
| Ex. No | Name | Wt % | SOLVENT 1 | ° C. | Min | Press MPA | (tunnel) mils | Press MPA | ° C. | Den | Mod gpd | Ten gpd | E % | BET SA | Type |
| 1 | TEFLON | 12 | PERFLUORO-DECALIN | 290 | 60 | 17.3 | 121 × 21 | 16.5 | 291 | 270 | 4.6 | 1.2 | 18 | 41 | plex |
| 2 | TEFLON | 12 | PERFLUORO-DECALIN | 290 | 60 | 17.3 | 50 × 50 | 7.6 | 292 | 489 | 1.5 | 1.3 | 27 | nm | plex |
| 3 | TEFLON | 15 | PERFLUORO-DECALIN | 290 | 60 | 13.9 | 50 × 50 | 4.1 | 289 | 877 | 8.2 | 1.6 | 33 | nm | plex |

Examples 4–9

In Examples 4–9, different concentrations of a copolymer comprised of polymerized monomer units of tetrafluoroethylene and perfluoro(propyl vinyl ether) (Teflon® PFA obtained from DuPont) were flash-spun from perfluorodecalin to form foam fibers. The Teflon® PFA (grade 350) was a high molecular weight grade with a melting point of 305° C.

Examples 14–17

In Examples 14–17, different concentrations of a copolymer comprised of polymerized monomer units of tetrafluoroethylene and perfluoro(substituted alkyl vinyl ether) (Nafion® XR obtained from DuPont) was flash-spun from perfluoro-N-methylmorpholine (PF5052) to form plexifilaments. Nafion® XR is a perfluorinated ion exchange polymer resin, with a melt flow rate of about 48 at 290° C.

TABLE 2

| | POLYMER | | | MIXING | | | SPINNING Orifice | | | Properties @ 10 TPI | | | | | |
|---|---|---|---|---|---|---|---|---|---|---|---|---|---|---|---|
| Ex. No | Name | Wt % | SOLVENT 1 | ° C. | Min | Press MPA | (tunnel) mils | Press MPA | ° C. | Den | Mod gpd | Ten gpd | E % | BET SA | Type |
| 4 | TEFLON | 20 | PERFLUORO-DECALIN | 290 | 60 | 17.3 | 30 × 30 (200 × 100) | 6.9 | 290 | 821 | 10 | 1.7 | 52 | 45 | foam |
| 5 | TEFLON | 23 | PERFLUORO-DECALIN | 290 | 60 | 10.4 | 30 × 30 (150 × 100) | 5.5 | 289 | 1019 | 1.2 | 1.7 | 56 | 33 | foam |
| 6 | TEFLON | 23 | PERFLUORO-DECALIN | 290 | 60 | 17.3 | 30 × 30 (200 × 100) | 10.3 | 289 | 1358 | 2.2 | 1.3 | 49 | 35 | foam |
| 7 | TEFLON | 23 | PERFLUORO-DECALIN | 290 | 60 | 10.4 | 30 × 30 (150 × 100) | 10.3 | 287 | 1287 | 1.2 | 1.4 | 59 | 35 | foam |
| 8 | TEFLON | 23 | PERFLUORO-DECALIN | 290 | 60 | 20.8 | T21 × 21 | 12.4 | 290 | 483 | 5.8 | 1.7 | 24 | nm | foam |
| 9 | TEFLON | 23 | PERFLUORO- | 290 | 60 | 20.8 | 30 × 30 | 12.4 | 291 | 559 | 6.4 | 2.1 | 25 | nm | foam |

Examples 10–13

In Examples 10–13, different concentrations of the following grades of a polymer comprised of polymerized monomer units of tetrafluoroethylene (Teflon® PTFE obtained from DuPont) were flash-spun from perfluorodecalin to form plexifilaments:

| Name and Grade | Form | Melting Point |
|---|---|---|
| Teflon ® PTFE 7A | Granular resin | 327° C. |
| Teflon ® PTFE T-62 | Fine powder | 327° C. |
| Teflon ® PTFE TE-3311 | Aqueous dispersion | 327° C. |

Note:
Teflon ® PTFE resins have very high MW (> 1 MM), and they do not have suitable solvents to measure molecular weights. Therefore, molecular weights for Teflon ® PTFE are not known although various estimates have been made for some of the polymers.

TABLE 3

| | POLYMER | | | MIXING | | | SPINNING Orifice | | | Properties @ 10 TPI | | | | | |
|---|---|---|---|---|---|---|---|---|---|---|---|---|---|---|---|
| Ex. No | Name | Wt % | SOLVENT 1 | ° C. | Min | Press MPA | (tunnel) mils | Press MPA | ° C. | Den | Mod gpd | Ten gpd | E % | BET SA | Type |
| 10 | TEFLON (7A) | 8 | PERFLUORO-DECALIN | 360 | 150 | 10.4 | 30 × 30 | 7.2 | 359 | 2246 | 1.7 | 0.5 | 164 | nm | plex |
| 11 | TEFLON (T62) | 6 | PERFLUORO-DECALIN | 330–360 | 60 | 13.9 | 50 × 50 | 6.3 | 361 | 649 | 8.8 | 0.6 | 22 | 24 | plex |
| 12 | TEFLON (T62) | 2 | PERFLUORO-DECALIN | 330 | 60 | 13.9 | T30 × 30 | 6.9 | 362 | 146 | 3 | 0.6 | 40 | nm | plex |
| 13 | TEFLON (TE-3311) | 4 | PERFLUORO-DECALIN | 360–370 | 45 | 10.3 | 30 × 30 | 9.7 | 406 | 183 | 4.3 | 0.7 | 13 | nm | plex |

TABLE 4

| | POLYMER | | | MIXING | | | SPINNING | | | Properties @ 10 TPI | | | | | |
|---|---|---|---|---|---|---|---|---|---|---|---|---|---|---|---|
| Ex. No | Name | Wt % | SOLVENT 1 | ° C. | Min | Press MPA | Orifice (tunnel) mils | Press MPA | ° C. | Den | Mod gpd | Ten gpd | E % | BET SA | Type |
| 14 | Nafion XR | 18 | PF5052 | 240 | 60 | 17.3 | 30 × 30 | 8.9 | 241 | nm | nm | nm | nm | 3.1 | plex |
| 15 | Nafion XR | 12 | PF5052 | 240 | 60 | 17.3 | 30 × 30 | 9.0 | 240 | 401 | 1 | 0.2 | 32 | 3 | plex |
| 16 | Nafion XR | 15 | PF5052 | 240 | 60 | 17.3 | 30 × 30 (200 × 100) | 9.0 | 239 | 409 | 0.8 | 0.2 | 39 | nm | plex |

Examples 17–23

In Examples 17–23, different concentrations of a copolymer comprised of polymerized monomer units of tetrafluoroethylene and perfluoro(substituted alkyl vinyl ether) (Nafion® XR obtained from DuPont) was flash-spun from perfluorodecalin alone, and from a mixture of perfluorodecalin and perfluoro-N-methylmorpholine (PF5052 obtained from 3M) at various solvent ratios. In each example a microcellular foam fiber was obtained.

TABLE 5

| | POLYMER | | SOLVENT | | | MIXING | | | SPINNING Orifice | | |
|---|---|---|---|---|---|---|---|---|---|---|---|
| Ex. No. | Name | Wt % | 1 | 2 | S1/S2 Wt % | ° C. | Min | Press MPa | (tunnel) mils | Press MPa | ° C. |
| 17 | Nafion XR | 55 | PERFLUORO-DECALIN | PF5052 | 80/20 | 220 | 60 | 13.9 | 30 × 30 | 2.5 | 219 |
| 18 | Nafion XR | 55 | PERFLUORO-DECALIN | PF5052 | 50/50 | 220 | 60 | 13.9 | 30 × 30 | 2.2 | 221 |
| 19 | Nafion XR | 50 | PERFLUORO-DECALIN | PF5052 | 95/5 | 220 | 30 | 17.3 | 30 × 30 | 2.2 | 220 |
| 20 | Nafion XR | 20 | PERFLUORO-DECALIN | NONE | 100/0 | 250–240 | 60 | 13.9 | 30 × 30 | 5.2 | 239 |
| 21 | Nafion XR | 30 | PERFLUORO-DECALIN | NONE | 100/0 | 215 | 60 | 13.9 | 30 × 30 | 3.5 | 215 |
| 22 | Nafion XR | 50 | PERFLUORO-DECALIN | NONE | 100/0 | 260 | 60 | 13.9 | 30 × 30 | 2.9 | 261 |
| 23 | Nafion XR | 50 | PERFLUORO-DECALIN | NONE | 100/0 | 260 | 60 | 13.9 | 30 × 30 | 2.5 | 264 |

Examples 24–26

In Examples 24–26, different concentrations of a blend of a copolymer of polymerized monomer units of tetrafluoroethylene perfluoro(propyl vinyl ether) (Teflon® PFA (350 grade) obtained from DuPont) and a copolymer of polymerized monomer units of tetrafluoroethylene and perfluoro (substituted alkyl vinyl ether) (Nafion® XR obtained from DuPont) was flash-spun from perfluorodecalin to form foam fibers.

TABLE 6

| | POLYMER | | | MIXING | | | SPINNING Orifice | | | Properties @ 10 TPI | | | | | |
|---|---|---|---|---|---|---|---|---|---|---|---|---|---|---|---|
| Ex. No. | Name | Wt % | SOLVENT 1 | ° C. | Min | Press MPa | (tunnel) mils | Press MPa | ° C. | DeN | Mod gpd | Ten gpd | E % | BET SA | Type |
| 24 | Teflon (50%) Nafion XR (50%) | 30 | PERFLUORO DECALIN | 290 | 90 | 13.9 | 30 × 30 | 3.5 | 292 | 1482 | 1.2 | 0.6 | 89 | 16 | foam |
| 25 | Teflon (50%) Nafion XR (50%) | 30 | PERFLUORO DECALIN | 275 | 90 | 13.9 | 30 × 30 (200 × 100) | — | 273 | 1425 | 1.4 | 0.7 | 61 | 18 | foam |
| 26 | Teflon (50%) Nafion XR (50%) | 23 | PERFLUORO DECALIN | 290 | 90 | 13.9 | 30 × 30 (200 × 100) | 4.2 | 288 | 998 | 2.5 | 1.1 | 37 | 35 | foam |

It will be apparent to those skilled in the art that modifications and variations can be made the flash-spinning apparatus and process of this invention. The invention in its broader aspects is, therefore, not limited to the specific details or the illustrative examples described above. Thus, it is intended that all matter contained in the foregoing description, drawings and examples shall be interpreted as illustrative and not in a limiting sense.

What is claimed is:

1. A flash-spun material comprised of at least 90% by weight of polymers selected from the groups A, B, or C;

wherein group A comprises polymers with a melting point above 280° C. that are comprised of halocarbon polymers in which at least 20% of the total number of halogen atoms in each halocarbon polymer are fluorine atoms;

wherein group B comprises polymers with a melting point above 280° C. that are comprised of oxyhalocarbon polymers in which at least 20% of the total number of halogen atoms in each oxyhalocarbon polymer are fluorine atoms; and wherein group C comprises fully halogenated, highly fluorinated ion exchange polymers.

2. The material of claim 1 wherein fluorine comprises at least 95% of the halogen atoms in at least 80% by weight of said polymers from groups A, B and C.

3. The material of claim 1 wherein at least 80% by weight of said group A halocarbon polymers and said group B oxyhalocarbons are comprised of tetrafluoroethylene.

4. The material of claim 1 wherein said group C fully halogenated, highly fluorinated ion exchange polymers comprise at least 80% by weight copolymers of tetrafluoroethylene and perfluoro(substituted alkyl vinyl ether).

5. The material of claim 1 wherein said flash-spun material is a plexifilamentary strand having a surface area, measured by the BET nitrogen adsorption method, greater than 2 $m^2/g$ comprising a three dimensional integral plexus of semi-crystalline, polymeric, fibrous elements, said elements being co-extensively aligned with the network axis and having the structural configuration of oriented film-fibrils, said film-fibrils having a mean film thickness of less than 4 microns and a median fibril width of less than 25 microns.

6. The material of claim 1 wherein said flash-spun material is a microcellular foam comprising closed polyhedral cells of polymeric material having thin film-like cell walls with an average thickness of less than 4 microns between adjoining cells.

7. A process for the production of flash-spun material comprised of a polymer that belongs to the groups A, B or C;

wherein group A comprises polymers with a melting point above 280° C. that are comprised of halocarbon polymers in which at least 20% of the total number of halogen atoms in each oxyhalocarbon polymer are fluorine atoms;

wherein group B comprises polymers with a melting point above 280° C. that are comprised of oxyhalocarbon polymers in which at least 20% of the total number of halogen atoms in each oxyhalocarbon polymer are fluorine atoms; and wherein group C comprises fully halogenated, highly fluorinated ion exchange polymers; which comprises the steps of:

forming a spin solution of said polymer in a solvent, said solvent having an atmospheric boiling point between 0° C. and 200° C., and being selected from the group consisting of perfluorinated hydrocarbons including cyclic and multi-ring compounds, perfluorinated morpholines, hydrofluorocarbons, and hydrofluoroethers; and spinning said spin solution at a pressure that is greater than the autogenous pressure of the spin solution into a region of substantially lower pressure and at a temperature at least 50° C. higher that the atmospheric boiling point of the solvent.

8. The process of claim 7 wherein said spin solution has a cloud point pressure of between the autogenous pressure and 50 MPa at temperatures in the range of 150° C. to 280° C., and wherein said spin solution is spun at a pressure of between the autogenous pressure and the cloud point pressure of the spin solution to form plexifilamentary film-fibril strands.

9. The process of claim 7 wherein said spin solution has a cloud point pressure of between the autogenous pressure and 50 MPa at temperatures in the range of 150° C. to 280° C. and wherein said spin solution is spun at pressure of between the cloud point pressure and 50 MPa to form a microcellular foam.

10. A solution comprising a solvent having an atmospheric boiling point of less than 200° C., and a fully halogenated, highly fluorinated ion exchange polymer, wherein the solution is at a pressure between the autogenous pressure and 50 MPa and at a temperature of between 150° to 280° C., the concentration of dissolved polymer in the solution being within the range of 5 to 60 weight percent of the solution.

11. The solution of claim 10 wherein said fully halogenated, highly fluorinated ion exchange polymer is comprised of at least 80% by weight of copolymers of tetrafluoroethylene and perfluoro(substituted alkyl vinyl ether).

12. The material of claim 2 wherein said flash-spun material is a plexifilamentary strand comprising a three dimensional integral plexus of semi-crystalline, polymeric, fibrous elements, said elements being co-extensively aligned with the network axis and having the structural configuration of oriented film-fibrils, said film-fibrils having a mean film thickness of less than about 4 microns and a median fibril width of less than about 25 microns.

13. The material of claim 3 wherein said flash-spun material is a plexifilamentary strand comprising a three dimensional integral plexus of semi-crystalline, polymeric, fibrous elements, said elements being co-extensively aligned with the network axis and having the structural configuration of oriented film-fibrils, said film-fibrils having a mean film thickness of less than about 4 microns and a median fibril width of less than about 25 microns.

14. The material of claim 4 wherein said flash-spun material is a plexifilamentary strand comprising a three dimensional integral plexus of semi-crystalline, polymeric, fibrous elements, said elements being co-extensively aligned with the network axis and having the structural configuration of oriented film-fibrils, said film-fibrils having a mean film thickness of less than about 4 microns and a median fibril width of less than about 25 microns.

15. The material of claim 4 wherein said group C fully halogenated, highly fluorinated ion exchange polymers comprise at least 80% by weight copolymers of tetrafluoroethylene and the perfluorinated vinyl ether $CF_2{=}CF{-}O{-}CF_2CF(CF_3){-}O{-}CF_2CF_2SO_2F$, perfluoro(3,6-dioxa-4-methyl-7-octenesulfonyl fluoride).

16. The material of claim 15 wherein said flash-spun material is a plexifilamentary strand comprising a three dimensional integral plexus of semi-crystalline, polymeric, fibrous elements, said elements being co-extensively aligned with the network axis and having the structural configuration of oriented film-fibrils, said film-fibrils having a mean film thickness of less than about 4 microns and a median fibril width of less than about 25 microns.

17. The solution of claim 11 wherein said fully halogenated, highly fluorinated ion exchange polymers comprise at least 80% by weight copolymers of tetrafluoroethylene and the perfluorinated vinyl ether $CF_2{=}CF{-}O{-}CF_2CF(CF_3){-}O{-}CF_2CF_2SO_2F$, perfluoro(3,6-dioxa-4-methyl-7-octenesulfonyl fluoride).

* * * * *

UNITED STATES PATENT AND TRADEMARK OFFICE

CERTIFICATE OF CORRECTION

PATENT NO. : 6,218,460 B1
DATED : April 17, 2001
INVENTOR(S) : Hyunkook Shin, William H. Tuminello It is certified that error appears in the above-identified patent and that said Letters Patent is hereby corrected as shown below:

Title page,
Item [63], change "Pat. No. 9,830,739" to read -- International Publication No. WO 98/30739 --.

Column 15,
Line 55, change "oxyhalocarbon" to read -- halocarbon --.

Signed and Sealed this

Twenty-ninth Day of January, 2002

*Attest:*

*Attesting Officer*

JAMES E. ROGAN
*Director of the United States Patent and Trademark Office*